US006000873A

United States Patent [19]

Burton

[11] Patent Number: 6,000,873

[45] Date of Patent: Dec. 14, 1999

[54] MODULAR BINDER

[75] Inventor: Joseph David Burton, Salt Lake City, Utah

[73] Assignee: Franklin Covey Co., Salt Lake City, Utah

[21] Appl. No.: 09/092,501

[22] Filed: Jun. 5, 1998

[51] Int. Cl.[6] ..... B42F 13/00

[52] U.S. Cl. ..... 402/75; 281/36

[58] Field of Search ..... 281/15.1, 21.1, 281/36, 37, 45, 51, 29; 402/70, 73, 75

[56] References Cited

U.S. PATENT DOCUMENTS

| | | | |
|---|---|---|---|
| 2,568,131 | 9/1951 | Segal | 281/29 |
| 3,175,847 | 3/1965 | McKowen | 281/36 |
| 3,262,454 | 7/1966 | Shillinger | 129/1 |
| 3,809,485 | 5/1974 | Beyer | 102/31 |
| 4,722,628 | 2/1988 | Rager | 402/75 |
| 5,160,209 | 11/1992 | Schuessler | 402/75 |
| 5,611,573 | 3/1997 | Lobel et al. | 281/36 |

*Primary Examiner*—Willmon Fridie, Jr.
*Attorney, Agent, or Firm*—Madson & Metcalf

[57] ABSTRACT

The present invention is a modular binder which allows for the quick exchange of binder covers and/or pocket inserts such that the user can customize his or her binder to a particular need or situation. The binder includes a ring assembly with a guide member attached near one end of the ring assembly. A first fastener portion is attached near a second end of the ring assembly. The binder includes a binder cover configured to receive the guide member. A second fastener portion is attached to the cover such that when the guide member is received by the cover, the first and second fastener portions can be releasably secured to each other. The modular binder also includes a pocket insert configured to be captured between the ring assembly and the binder cover.

24 Claims, 5 Drawing Sheets

MODULAR BINDER

BACKGROUND

1. The Field of the Invention

The present invention is related to a modular binder. More particularly, the present invention is related to a modular binder having a removable ring assembly with a guide member and an anchor, a detachable insert with a selection of pockets, and a binder cover configured to receive and secure the ring assembly and detachable insert.

2. Technical Background

Personal productivity has become an ever-increasing goal for many people as they try to juggle their daily schedules. One tool for aiding personal productivity is a calender or planner system which includes a series of pages corresponding to the days, weeks, or months of the year. These pages allow the user to plan his or her activities on a regular basis. Most planning or calender systems are contained in a binder and used on a daily basis. Other people, such as students, also have need for a binder on a daily basis. Accordingly an increasing number of people are carrying binders with them wherever they go. Many even use them in place of a wallet or purse.

Most binders come with some sort of paper entrapment system, such as a ring assembly, that is permanently affixed to a binder cover. However, with the increase in personal binder users, it would be advantageous to be able to vary the appearance of the binder without having to remove all the paper from the entrapment mechanism. If the entrapment mechanism where removable, it would allow a user to easily change the appearance of the binder to fit a particular situation. For example, a rugged-textured colorful binder, typically used in less formal situations, could become a black leather binder, suitable for more formal circumstances, by simply switching out the paper entrapment mechanism to the more formal black cover.

Thus, there have been some attempts to create a binder with a removable ring assembly. Some designs include a pair of posts affixed to a spine portion of the binder cover. The ring assembly is configured with a pair of holes for receiving the posts. In one design by Segal (U.S. Pat. No. 2,568,131), the posts are configured to engage keyholes. A separate mechanism is used to lock the ring assembly in place. In this configuration, however, the attachment of the ring assembly to the binder cover is not easily accomplished. Each end of the ring assembly must be simultaneously aligned with the posts in order for the ring assembly to be secured to the binder cover. This simultaneous alignment is often tedious and time consuming, especially when the holes in the ring assembly are obscured by the paper entrapped within the ring assembly. Often times, the paper must be separated or even removed completely before alignment can be accomplished.

Another design by Shillinger (U.S. Pat. No. 3,262,454) similarly employs a pair of posts which must be simultaneously aligned with opposing holes in the ring assembly to secure the ring assembly. In this design, the ring assembly is secured in place by a pair of clips, which once secured, are difficult to remove. Further, the clips are separate pieces which are susceptible to being lost. Thus, it would be advancement in the art to provide a modular binder with a ring assembly that is easily secured in place. It would be a further advancement to provide a modular binder that could be locked in place without the need for a separate locking mechanism or non-attached locking pieces.

Some binders have covers configured with pockets to store pens, business cards, or any number of items. Like most ring assemblies, however, these pockets are a permanent part of the binder. These binders do not allow the user to alter the pocket configuration to suit a particular situation or need. Thus, it would be an additional advancement in the art to provide a modular binder configured to receive a detachable pocket insert having a variety of pocket configurations.

From the foregoing, it will be appreciated that it would be an advancement in the art to provide a durable and versatile modular binder with a ring assembly that can be easily secured to, and released from, the binder cover allowing the user to have a variety of binder "looks." It would be a further advancement to provide such a modular binder with a positive anchor that did not require a separate or additional locking assembly or unattached locking pieces to secure the ring assembly to the binder cover. It would be an additional advancement to provide such a modular binder with a detachable pocket insert that could be easily switched out for another insert with a different pocket configuration.

Such a modular binder is disclosed and claimed herein.

BRIEF SUMMARY OF THE INVENTION

The present invention is directed to a novel modular binder which allows for the quick exchange of binder covers and/or pocket inserts such that the user can customize his or her binder to a particular need or situation. The modular binder of the present invention includes a ring assembly with an attachment portion. A guide member is connected to the attachment portion near a first end of the removable ring assembly. In one embodiment, the guide member is an elongated tab having a first end attached to the attachment portion of the ring assembly and a rounded end opposite or distal from the first end. The elongated tab is configured with a biasing portion between the first end and the rounded end. In another preferred embodiment, the guide member is a rivet which includes a neck portion with a flange portion extending from the neck portion.

The modular binder includes a binder cover with a pocket along the spine of the binder cover. In one preferred embodiment, the pocket is partially defined by an opening or slit for receiving the elongated tab. In another preferred embodiment, where the guide member is a flanged rivet, the cover includes a pair of prongs for receiving the rivet. In yet another preferred embodiment, the cover includes leaf portions, each configured with a pocket, such that a tab member attached to the ring assembly can be slid into the pocket and the ring assembly can be positioned near the spine of the binder cover. A tab member attached to a pocket member, configured with one or more pockets, may also be slid into the binder cover.

The modular binder of the present invention may include an anchor with a first fastener portion connected to the attachment portion of the ring assembly near the second end and a second fastener portion connected to the cover. In this configuration, when the guide member is received by the cover, the first fastener portion can be releasably secured to the second fastener portion. In a preferred embodiment, the first and second fastener portions are male and female snap members configured to releasably engage each other. The combination of a guide member and a positive anchor such as a snap, allows the user to easily switch out the ring assembly for use with a different binder cover. The user can attach the ring assembly to another binder cover without having to align both ends of the ring assembly with the binder cover at the same time.

The present invention may also include a detachable insert having at least one pocket. In one embodiment, the insert is configured for positioning between the ring assembly and the cover, such that when ring assembly is releasably anchored to the cover, the insert is retained in place. The detachable insert may be configured with an opening, such that the ring assembly can be releasably secured to the binder cover through the opening. The detachable insert may also be configured with a groove, such that the insert can be positioned for retention between the cover and the ring assembly without hindering the insertion of the elongated tab into the opening of the pocket of the cover. This configuration allows the user to customize his or her binder with different pocket inserts having a variety of pocket configurations.

These and other advantages of the present invention will become more fully apparent by examination of the following description of the preferred embodiments and the accompanying drawings.

BRIEF DESCRIPTION OF THE DRAWINGS

To better understand the invention, a more particular description of the invention will be rendered by reference to the appended drawings. These drawings only provide information concerning typical embodiments of the invention and are not to be considered limiting of its scope. The invention will be described and explained with additional specificity and detail through the use of the accompanying drawings, in which.

DETAILED DESCRIPTION OF THE PREFERRED EMBODIMENTS

Figure 1:
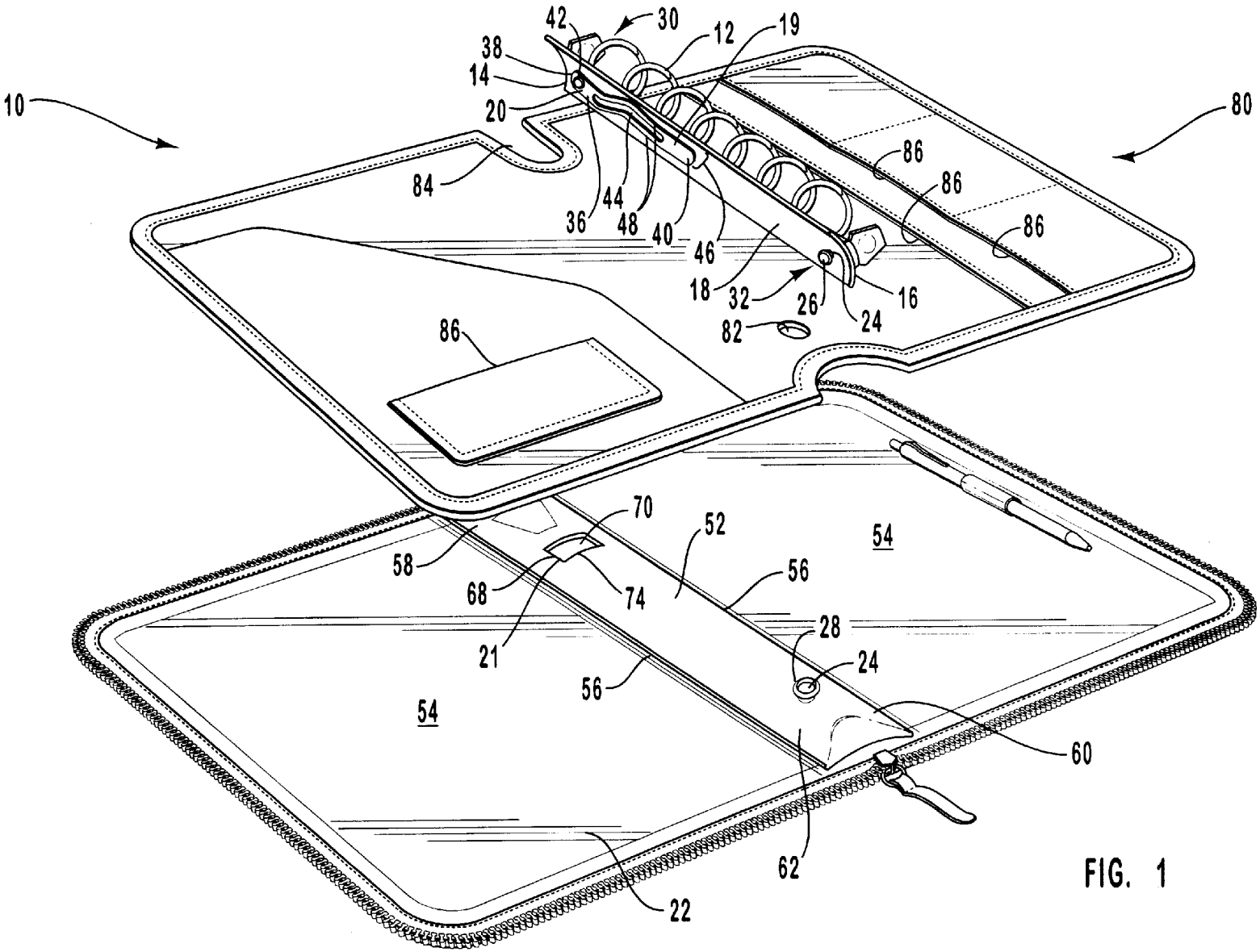
FIG. 1 is a perspective view of one embodiment of the modular binder of the present invention.

Reference is now made to the figures wherein like parts are referred to by like numerals throughout. With particular reference to FIG. 1, a modular binder system according to the present invention is generally designated at 10.

The binder system 10 includes a ring assembly 12 having a first end 14, a second end 16, and an attachment portion 18. A first positioning member 19 is connected to the attachment portion 18 near the first end 14 of the ring assembly 12. The modular binder also includes a binder cover 22 configured with a second positioning member 21 for slidable engagement with the first positioning member 19. The modular binder 10 has an anchor 24 which includes a first fastener portion 26 connected to the attachment portion 18 near the second end 16 of the ring assembly 12. A second fastener portion 28 of the anchor 24 is connected to the binder cover 22 such that when the first positioning member 19 is releasably engaged with the second positioning member 21, the first fastener portion 26 can be releasably secured to the second fastener portion 28. This allows the ring assembly 12 to be releasably secured to the cover 22. In a presently preferred embodiment, the first positioning member 19 is a metal guide member 20.

In a preferred embodiment, the ring assembly 12 will have a first hole 30 positioned near the first end 14 of the ring assembly 12 and a second hole 32 positioned near the second end 16 of the ring assembly 12. The ring assembly 12 of the present invention may be one of any number of those commercially available, including but not limited to ring assemblies made by Charles Leonard or Koloman Handler.

In one preferred embodiment, the guide member 20 is an elongated tab 36. The elongated tab 36 includes a first end 38, attached near the first end 14 of the attachment portion 18 of the ring assembly 12, and a second end 40 distal from the first end 38. The first end 38 of the elongated tab 36 includes a hole 42, which when aligned with the first hole 30 in the ring assembly, allows a screw, a nut, washer and bolt, or a rivet to secure the elongated tab 36 to the ring assembly 12. It will be appreciated by those of skill in the art that a number ways may be used to attach the elongated tab 36 to the ring assembly 12. These include spot welding the elongated tab 36 to the ring assembly 12 or configuring the ring assembly 12 such that the elongated tab 36 is an integral extension of the attachment portion 18 of the ring assembly 12.

The elongated tab 36 comprises a biasing portion 44 between the first end 38 and the second end 40. The biasing portion 44 is configured to urge a portion of the cover 22 against the ring assembly 12 when the elongated tab 36 is positioned within the cover 22 (see FIG. 2). In one preferred embodiment, the biasing portion 44 is a bulge or curve in the relatively planer elongated tab 36. It will be appreciated by those of skill in the art that the bulge 44 should be of sufficient size such that when the first end 38 of the elongated tab 36 is attached to the attachment portion 18 of the ring assembly 12, the bulge 44 extends into the attachment portion 18. This configuration adds stability when the ring assembly 12 is secured to the binder cover 22 and reduces the amount of movement of the ring assembly 12 relative to the binder cover 22.

The second end 40 of the elongated tab 36 is rounded to facilitate easy insertion into the binder cover 22. The second end 40 extends away from the attachment portion 18 of the ring assembly 12 at the biased portion 44. This creates a gap 46 between the rounded end 40 and the attachment portion 18 of the ring assembly 12 which also allows for easy insertion of the elongated tab 36 into the binder cover 22.

In a presently preferred embodiment, the elongated tab 36 is made of tempered spring steel. Those of skill in the art will appreciate that this material allows the second end 40 of the elongated tab 36 to be rounded and allows edges of the elongated tab 36 to be dulled, thereby diminishing any chance of injury to the user because of the thinness of the blade. It will further be appreciated by those of skill in the art that the tempering of the spring steel affects the steel's memory coefficient and the steel should be resilient enough to maintain its biasing properties. It will also be appreciated that the teachings of this invention can be accomplished with the elongated tab 36 made from other materials such as certain plastics, rubbers, ceramics, or metal alloys.

The cover 22 preferably includes a spine portion 52 with leafs 54 flexibly secured to opposite edges 56 of the spine portion 52. The cover 22 may be one of any number of commercially available covers. The spine portion 52 of the cover includes a first end 58 and a second end 60. In the preferred embodiment, the spine 52 of the binder cover 22 includes an inner portion 62 and an outer portion 64 (shown in FIG. 2) attached at the edges 56 and at the first end 58 and second end 60 of the spine 52. It will be appreciated by those of skill in the art that this configuration creates an enclosed area in which a spine support 66 (shown in FIG. 2) may be found.

In one preferred embodiment, the second positioning member 21 is an opening 68. The opening 68 is configured in the binder cover 22 near the first end 58 of the spine 52, and together with the otherwise enclosed area, defines a pocket 70. The opening 68 in one preferred embodiment is a lateral slit having a length slightly longer than the width of the elongated tab 36. The spine material around the slit 68 is preferably reinforced to provide durability.

The opening 68 is configured in the spine 52 such that as the elongated tab 36 is inserted through the opening 68, the second end 16 of the ring assembly 12 has enough play to allow the user to orient or pivot the second end 16 to easily align and secure the second end 16 of the ring assembly 12 to the anchor 24 (discussed in detail below) without having to simultaneously align both ends 14, 16 of the ring assembly 12. The position of the opening 68 in the spine 52 aids the attachment of the ring assembly 12 to the spine 52 in that the opening 68 acts as a stop. For example, the opening 68 can be positioned such that a point of attachment 72 between the elongated tab 36 and the ring assembly 12 engages a first side 74 of the opening 68 at the point where the ring assembly 12 is in position for securement to the binder cover 22.

It will be appreciated by those of skill in the art that the guiding function accomplished by the slit 68 in the spine 52 of the present invention 10 can be accomplished in various ways. These may include the use of ringlets or eyelets attached to, or positioned in the spine portion 52 and configured to receive the elongated tab 36. It will also be appreciated by those of skill in the art that the guide member 20 could be secured to the binder cover 22 and an opening 68 or other means for receiving the guide member 20 could be configured within, or attached to, the ring assembly 12.

The anchor 24 of the modular binder in one preferred embodiment of the present invention includes a first fastener portion 26 connected to the attachment portion 18 near the second end 16 of the ring assembly 12, and a second fastener portion 28 connected near the second end 60 of the spine portion 52. As can best be seen by reference to FIG. 2, the anchor 24 is configured such that when the guide member 20 is substantially received by the cover 22, the first fastener portion 26 can be releasably secured to the second fastener portion 28. It will be appreciated by those of skill in the art that a fastener or anchor 24 can be attached to the ring assembly 12 in a variety of ways, including welding or bonding. In a preferred embodiment the fastener is riveted to the ring assembly through the second hole 32 in ring assembly 12. Other ways may include using a screw or a nut, washer and bolt configuration. Similarly, there are various ways to attach the anchor 24 or fastener to the binder cover 22. Presently, the second fastener portion 28 is riveted to the binder cover 22. Accordingly, the ring assembly 12 is releasably secured to the binder cover 22 and the binder cover 22 can be easily swapped-out according to the whim of the user.

In a presently preferred embodiment, the first fastener portion 26 of the anchor 24 is the male member of a snap and the second fastener portion 28 of the anchor 24 is a female member of a snap configured to matingly engage the first fastener portion 26. It will be appreciated by those of skill in the art the first fastener portion 26 may be the female member and the second fastener portion 28 may be the male member. It will further be appreciated that there are a variety of snap configurations which may be used to accomplish the desired anchoring effect. Further, the anchor 24 could be configured in a variety of ways to practice the teachings of this invention. For example, the anchor 24 could comprise a spring load mechanism in a post secured to the binder cover 22. As the second hole 32 in the ring assembly 12 is positioned over the post, and a predetermined portion of the post clears the hole 32, a tab, stop, or portion of the post could flare out entrapping the ring assembly 12. The anchor might also include a hook and loop configuration or a pair of properly polarized magnets. The snap provides a positive anchor which alleviates the need for a separate locking mechanism, or loose, unattached locking pieces.

Figure 2:
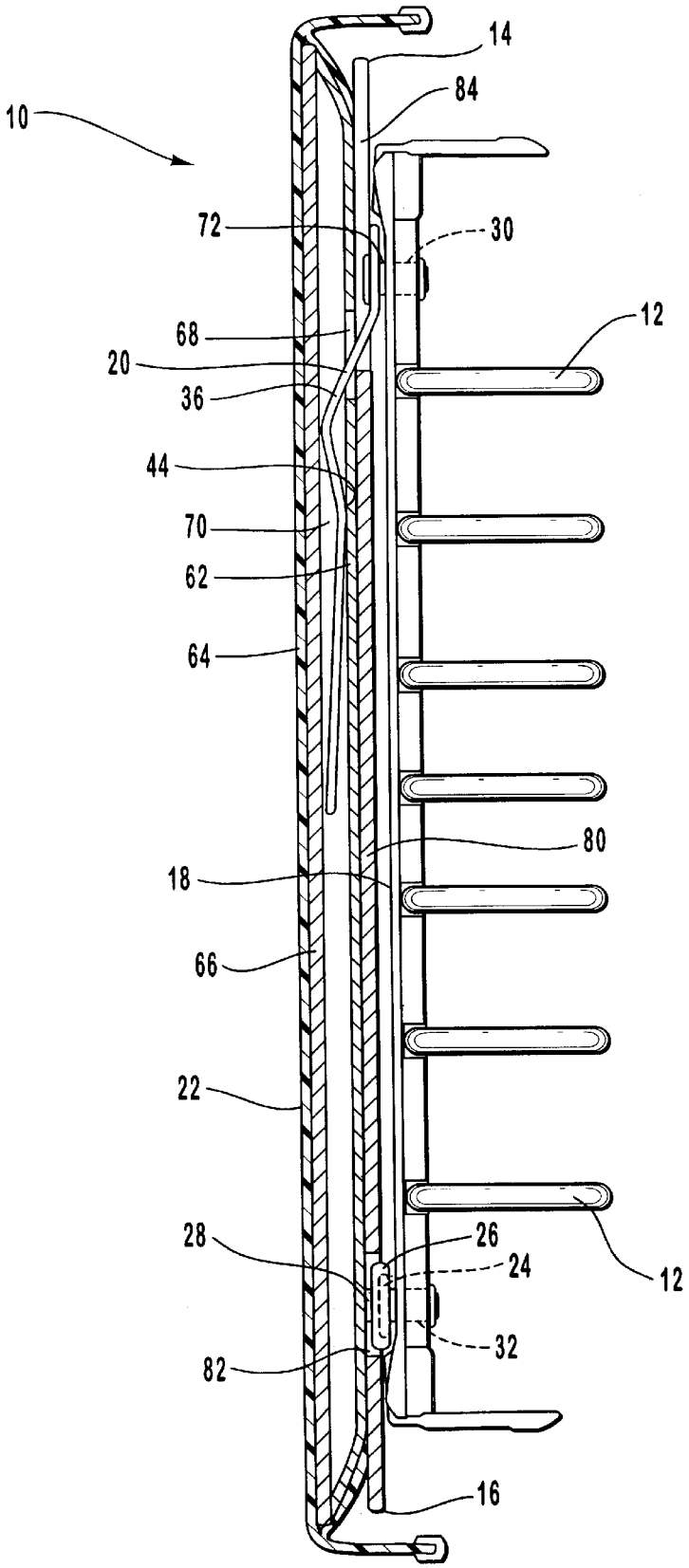
FIG. 2 is a side cross-sectional view of the modular binder system of FIG. 1.

In the presently preferred embodiment illustrated in FIGS. 1 and 2, the opening 68 in the binder cover 22 for receiving the elongated tab 36 is laterally aligned with the second fastener portion 28 in the binder cover 22 along the spine 52. It will be appreciated by those of skill in the art that the opening 68 and fastener portion 28 may be positioned in either leaf 54 of the binder cover 22 and still provide the advantages of this invention.

Referring again to FIG. 1 the present invention 10 includes a detachable insert 80. The insert 80 is configured for disposition between the ring assembly 12 and the cover 22, such that when the ring assembly 12 is releasably secured to the cover 22, the insert 80 can be retained between the ring assembly 12 and the binder cover 22. To accomplish this desired effect, the insert 80 is configured with an opening 82 to allow the first fastener portion 26 to be releasably secured to the second fastener portion 28 through the opening 82 when the insert 80 is in the desired position. The detachable insert 80 may also be configured with a groove 84 opposite the insert opening 82, such that when the insert 80 is disposed for retention between the cover 22 and the ring assembly 12, the opening 68 of the binder cover 22 is positioned within the groove 84. In this configuration, the insert 80 will not interfere with the point of attachment 72 between the elongated tab 36 and the ring assembly 12 as the tab 36 is slid into the opening (see FIG. 2).

The detachable insert 80 has at least one pocket 86. In preferred embodiment, the detachable insert 80 may have many pockets and/or sleeves 86 in a variety of configurations. It will be appreciated that the configuration of the detachable insert 80, to permit the retention of the insert 80 between the ring assembly 12 and the binder cover 22, may depend in large part on how the ring assembly 12 is secured to the binder cover 22.

Referring now to FIG. 2, the present invention 10 is shown in cross-sectional view. The insert 80 is entrapped between the ring assembly 12 and the cover 22. The elongated tab 36 is positioned within the pocket 70 with the point of attachment 72 positioned within the groove 84 of the detachable insert 80 near the opening 68. The biasing portion 44 of the elongated tab 36 urges the inner portion 62 of the binder cover 22 against the attachment portion 18 of the ring assembly 12. The first fastener portion 26 is removably anchored to the second fastener portion 28.

Figure 3:
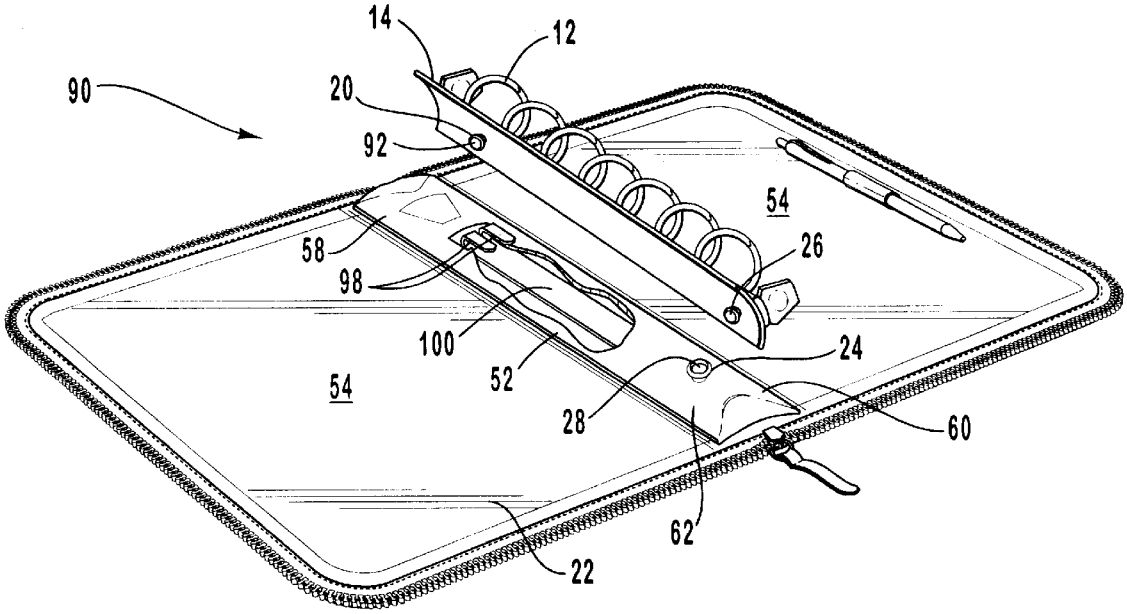
FIG. 3 is a perspective view of another embodiment of the modular binder of the present invention.
Figure 4:
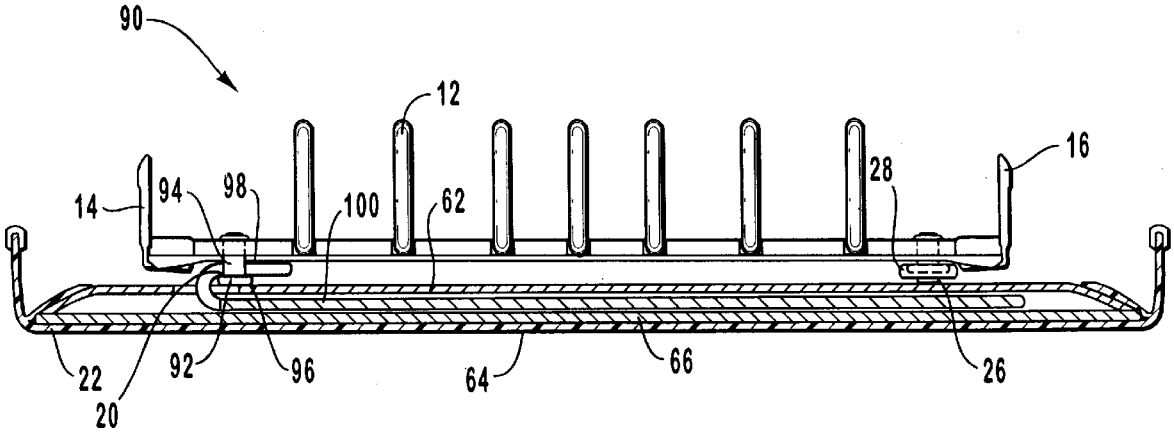
FIG. 4 is a side cross-sectional view of the modular binder system of FIG. 3.

Referring now to FIGS. 3 and 4, an alternative embodiment 90 of the present invention is shown. This embodiment includes a guide member 20 which comprises a rivet 92 having a neck 94 and a flange portion 96 extending from the neck 94. Instead of a slit 68 (FIG. 1) in the binder cover 22, the neck 94 is received in by at least one, and preferably two prongs 98 positioned near the first end 58 of the spine portion 52. These prongs 98 receive and substantially retain the flange portion 96 of the guide member 20 when the second end 16 of the ring assembly 12 is anchored. In this preferred embodiment, the prongs 98 are integral with a bar portion 100 which is positioned between the inner portion 62 and the outer portion 64 of the binder cover 22 adjacent the spine support 66. The bar portion 100 is secured near the second end 60 of the spine portion 52 with the same means used to secure the anchor 24 or portion thereof to the binder cover 22.

It will be appreciated by those of skill in the art that a variety of prong configurations may be used to allow the first end 14 of the ring assembly 12 to be slid into place and then anchored at the second end 16 of the ring assembly 12. It will also be appreciated by those of skill in the art that to minimize undesirable shifting to the ring assembly 12 relative to the binder cover 22, the distance between prongs 98 should only be slightly greater than the width of the neck 94 on the guide member 20. It will further be appreciated by those of skill in the art that the guide member could be attached to the binder cover 22 and the prongs 98 could be attached to the ring assembly 12. In this preferred embodiment, the prongs 98 and bar portion 100 are integral and made of mild steel. It will also be appreciated by those of skill in the art that the bar portion 100 will act as a spine support 66 and will obviate the need for a separate spine support 66.

The ring assembly 12 of the embodiment illustrated in FIGS. 1 and 2 is attached to the cover 22 by first inserting the elongated tab 36 into the opening 68 of the binder cover 22. The second end 16 of the ring assembly 12 is then snapped or anchored into place by connecting the first fastener portion 26 to the second fastener portion 28. The ring assembly 12 of the embodiment illustrated in FIGS. 3 and 4 is attached to the cover 22 by first inserting the neck 94 of the rivet 92 into the prongs 98 of the binder cover 22. The second end 16 of the ring assembly 12 is then snapped or anchored into place by connecting the first fastener portion 26 to the second fastener portion 28. In both of these embodiments, it will be appreciated by those of skill in the art that after the guide member 20 (whether an elongated tab 36 or a flanged rivet 92) is positioned relative to the cover 22, the other end of the ring assembly 12 has enough play to allow the user to orient or pivot the second end 16 to easily align and secure the second end 16 of the ring assembly 12 by connecting the first 26 and second 28 fastener portions to each other. Accordingly, both ends 14, 16 of the ring assembly 12 do not have to be simultaneously aligned with the cover 22 before the ring assembly 12 can be attached.

The detachable insert 80 can be used with either of these embodiments by positioning the insert 80 within the binder cover 22 with the groove 84 of the insert 80 positioned near the point of attachment of the guide member 20 (whether it be the elongated tab 36 or the flanged rivet 92) to the ring assembly 12. The second end 16 of the ring assembly 12 can be releasably anchored to the binder cover 22 through the opening 82 in the insert 80, thereby securing the inserting between the ring assembly 12 and the binder cover 22.

Figure 5:
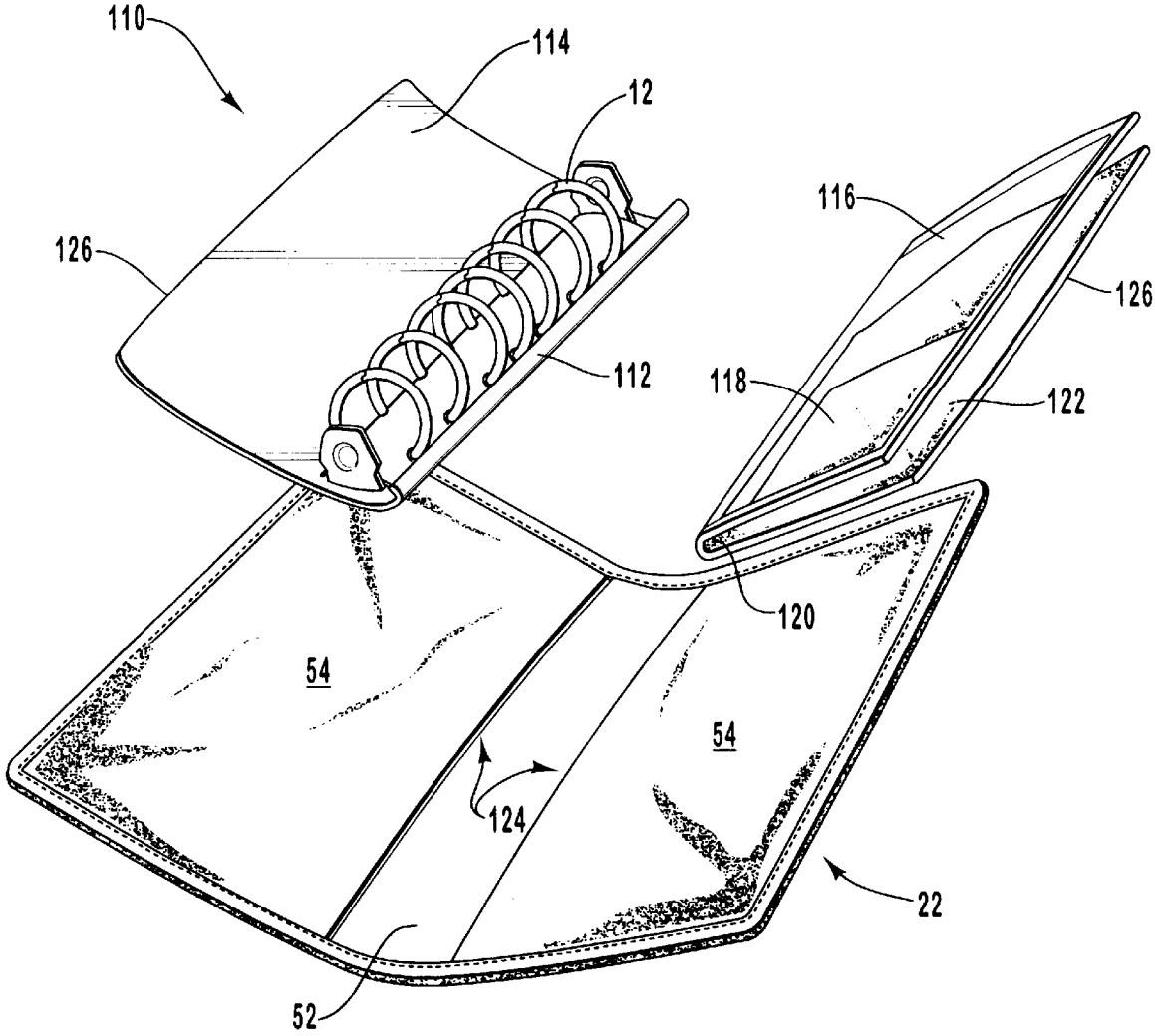
FIG. 5 is a perspective view of another embodiment of the modular binder of the present invention.
Figure 6:
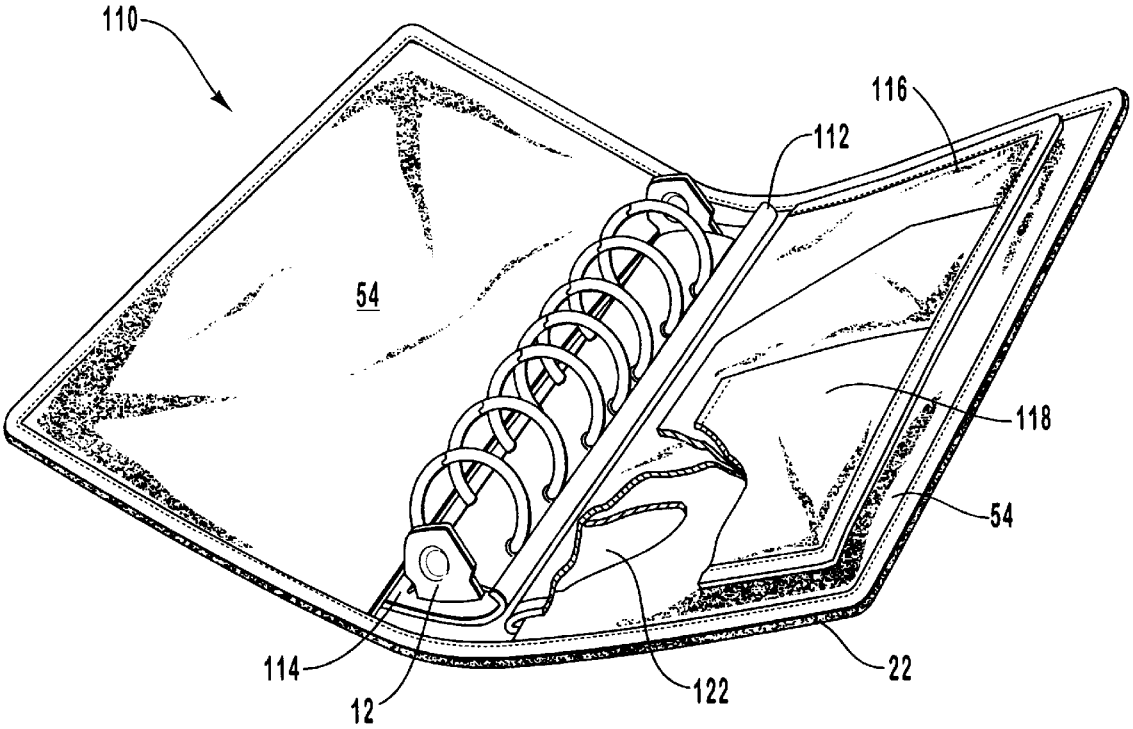
FIG. 6 is a perspective partially cut away view of the modular binder system of FIG. 5.

Referring now to FIGS. 5 and 6, an alternative embodiment 110 of the present invention is shown. In this embodiment, the attachment portion 18 (not shown) of the ring assembly 12 is affixed to a first end 112 of a first tab member 114. A pocket member 116, having at least one pocket 118, is attached to a first end 120 of a second tab member 122. Each leaf 54 is configured with a leaf pocket 124 into which a second end 126 of either tab member 114, 122 may be slid. In this configuration, the first tab member 114 attached to the ring assembly 12 may be received and releasably retained such that the ring assembly 12 is positioned near the spine portion 52. This is accomplished by simply sliding the first tab member 114 into one of the leaf pockets 124 of the binder cover 22. Additionally, the second tab member 122 attached to the pocket member 116 may be received and releasably retained in the other leaf pocket 124. Likewise, this is done by sliding the second tab member 122 into a leaf pocket 124 of the binder cover 22. In this embodiment, pocket members 116 with a variety of different pocket 118 configurations, can easily be exchanged, along with the ring assembly, into a variety of different binder covers 22.

In a preferred embodiment, the first tab member 114 and second tab member 122 are made of poly propylene. The ring assembly 12 is attached to the first tab member 114 by rivets. The pocket member 116 is attached to the second tab member 122 with a bonding material. It will be appreciated by those of skill in the art that the tab members 114 and 122 can be made from a variety of materials including other plastics or rubbers, ceramics, wood, aluminum or a variety of other metal alloys. Likewise, the ring assembly 12 and pocket member 116 can be affixed to the tab members 114 and 122 by a variety of means including glue or other bonding substances, or thread.

It should be appreciated that the apparatus and methods of the present invention are capable of being incorporated in the form of a variety of embodiments, only a few of which have been illustrated and described above. The invention may be embodied in other forms without departing from its spirit or essential characteristics. The described embodiments are to be considered in all respects only as illustrative and not restrictive and the scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. A modular binder, comprising:

a ring assembly having a first end, a second end, and an attachment portion;

a first positioning member connected to the attachment portion near the first end of the ring assembly;

a binder cover having a second positioning member configured for slidable engagement with the first positioning member; and an anchor having a first fastener portion connected to the attachment portion near the second end of the ring assembly and a second fastener portion connected to the cover, such that when the first positioning member is slidably engaged with the second positioning member, the first fastener portion can be releasably secured to the second fastener portion, thereby permitting the ring assembly to be releasably secured to the cover.

2. A modular binder, comprising:

a ring assembly having a first end, a second end, and an attachment portion;

a guide member connected to the attachment portion near the first end of the ring assembly;

a binder cover configured to receive the guide member; and an anchor having a first fastener portion connected to the attachment portion near the second end of the ring assembly and a second fastener portion connected to the cover, such that when the guide member is received by the binder cover, the first fastener portion can be releasably secured to the second fastener portion, thereby permitting the ring assembly to be releasably secured to the cover.

3. The modular binder of claim 2, wherein the guide member comprises an elongated tab.

4. The modular binder of claim 3, wherein the elongated tab comprises a biasing portion for urging the cover against the ring assembly when the elongated tab is positioned within the binder cover.

5. The modular binder of claim 3, wherein the elongated tab comprises a first end attached to the attachment portion of the ring assembly, and a second end distal from the first end.

6. The modular binder of claim 5, wherein the second end is rounded.

7. The modular binder of claim 3, wherein the cover is configured with a pocket having an opening configured to receive and retain the elongated tab.

8. The modular binder of claim 3, wherein the cover is configured with at least one eyelet configured to receive the elongated tab.

9. The modular binder of claim 2, wherein the guide member comprises a rivet having a neck and a flange portion extending from the neck.

10. The modular binder of claim 9, wherein the cover comprises at least one prong configured to receive the rivet.

11. The modular binder of claim 2, wherein the first fastener portion comprises a male member of a snap.

12. The modular binder of claim 11, wherein the second fastener portion comprises a female member of a snap configured to receive and releasably retain the male member of said snap.

13. The modular binder of claim 2, further comprising a detachable insert configured for disposition between the ring assembly and the binder cover, such that when ring assembly is releasably secured to the cover, the insert can be retained between the ring assembly and the binder cover.

14. The modular binder of claim 13, wherein the detachable insert is configured with an opening, thereby permitting the first fastener portion to be releasably secured to the second fastener portion through the opening.

15. The modular binder of claim 13, wherein the detachable insert has at least one pocket.

16. A modular binder, comprising:

a ring assembly having a first end, a second end, and an attachment portion;

an elongated tab connected to the attachment portion near the first end of the removable ring assembly;

a binder cover configured with a pocket having an opening to receive the elongated tab;

an anchor having a first fastener portion connected to the attachment portion near the second end of the ring assembly and a second fastener portion connected to the cover, such that when the guide member is received by the cover, the first fastener portion can be releasably secured to the second fastener portion, thereby permitting the ring assembly to be releasably secured to the cover; and a detachable insert having at least one pocket configured for disposition between the ring assembly and the cover, such that when ring assembly is releasably secured to the cover, the insert is retained in place.

17. The modular binder of claim 16, wherein the elongated tab is configured with a first end attached to the attachment portion of the ring assembly, and a rounded end distal from the first end.

18. The modular binder of claim 16, wherein the elongated tab comprises a biasing portion between the first end and the rounded end for urging the cover against the ring assembly when the elongated tab is positioned within the cover.

19. The modular binder of claim 18, wherein the rounded end of the elongated tab extends away from the attachment portion of the ring assembly between the biasing portion and the rounded end, thereby allowing the rounded end to be easily inserted into the pocket in the binder cover.

20. The modular binder of claim 16, wherein the elongated tab is comprised of tempered spring steel.

21. The modular binder of claim 16, wherein the detachable insert is configured with an opening, thereby permitting the first fastener portion to be releasably secured to the second fastener portion through the opening.

22. The modular binder of claim 21, wherein the detachable insert is configured with a groove, such that when the insert is disposed for retention between the cover and the ring assembly, the opening of the pocket of the cover is positioned within the groove.

23. A modular binder, comprising:

a ring assembly having a first end, a second end, and an attachment portion;

an elongated tab attached to the attachment portion near the first end of the removable ring assembly, the elongated tab having a biasing portion;

a first snap member attached to the attachment portion adjacent a second end of the ring assembly;

a cover configured with a pocket having an opening to receive the elongated tab;

an second snap member configured to receive and releasably retain the first snap member in mating engagement, the second snap member affixed to the cover such that the elongated tab can be positioned within the slot, while the first snap member is positioned opposite the second snap member, thereby permitting the ring assembly to be releasably secured to the cover; and a detachable insert having at least one pocket, the detachable insert configured with an opening configured to permit the first snap member to be releasably secured to the second snap member through the opening, the detachable insert also being configured with a groove, such that when the first snap member is positioned to be releasably secured to the second snap member through the opening, the opening of the pocket in the cover is positioned within the groove.

24. A modular binder, comprising:

a ring assembly having an attachment portion;

a first tab member attached at a first end to the attachment portion;

a pocket member configured with at least one pocket;

a second tab member attached at a first end to the pocket member; and a binder cover having a spine portion, and at least a pair of leaf portions flexibly secured to opposite edges of the spine portion, the leaf portions configured to receive and releasably retain the first tab member such that the ring assembly is positioned near the spine portion and the leaf configured to receive and releasably retain the second tab member.

* * * * *